US010964503B2

(12) United States Patent
Minowa et al.

(10) Patent No.: US 10,964,503 B2
(45) Date of Patent: Mar. 30, 2021

(54) RELAY

(71) Applicant: Omron Corporation, Kyoto (JP)

(72) Inventors: Ryota Minowa, Kumamoto (JP); Hiroyuki Iwasaka, Kumamoto (JP); Yasuo Hayashida, Kumamoto (JP); Shingo Mori, Kumamoto (JP); Naoki Kawaguchi, Kumamoto (JP)

(73) Assignee: Omron Corporation, Kyoto (JP)

( * ) Notice: Subject to any disclaimer, the term of this patent is extended or adjusted under 35 U.S.C. 154(b) by 115 days.

(21) Appl. No.: 16/282,507

(22) Filed: Feb. 22, 2019

(65) Prior Publication Data

US 2019/0304729 A1 Oct. 3, 2019

(30) Foreign Application Priority Data

Mar. 30, 2018 (JP) ..... JP2018-068869

(51) Int. Cl.
*H01H 3/00* (2006.01)
*H01H 50/58* (2006.01)
(Continued)

(52) U.S. Cl.
CPC ..... *H01H 50/58* (2013.01); *H01H 1/54* (2013.01); *H01H 50/14* (2013.01); *H01H 50/42* (2013.01);
(Continued)

(58) Field of Classification Search
CPC ..... H01H 50/42
(Continued)

(56) References Cited

U.S. PATENT DOCUMENTS 4,467,301 A * 8/1984 Goodrich ..... H01H 1/54 335/195
8,698,582 B2 * 4/2014 Uchida ..... H01H 1/54 335/147
(Continued)

FOREIGN PATENT DOCUMENTS

CN 102891039 A 1/2013
CN 103548110 A 1/2014
(Continued)

OTHER PUBLICATIONS

Office Action issued in the counterpart Chinese Patent Application No. 201910110089.X, dated Dec. 14, 2020 (8 pages).

*Primary Examiner* — Alexander Talpalatski
(74) *Attorney, Agent, or Firm* — Osha Bergman Watanabe & Burton LLP

(57) ABSTRACT

A relay has a case, a first fixed terminal including a first fixed contact, a second fixed terminal including a second fixed contact, a movable touch piece including a first movable contact that is disposed facing the first fixed contact and a second movable contact that is disposed facing the second fixed contact, the movable touch piece being disposed in the case and disposed so as to be movable in a contact direction in which the first movable contact and the second movable contact come into contact with the first fixed contact and the second fixed contact and a separation direction in which the first movable contact and the second movable contact separate from the first fixed contact and the second fixed contact. The first fixed terminal includes a first contact support configured to support the first fixed contact.

20 Claims, 13 Drawing Sheets

(51) Int. Cl.

| | |
|---|---|
| ***H01H 50/42*** | (2006.01) |
| ***H01H 50/64*** | (2006.01) |
| ***H01H 1/54*** | (2006.01) |
| ***H01H 50/14*** | (2006.01) |

(52) U.S. Cl.
CPC ..... *H01H 50/64* (2013.01); *H01H 2205/002* (2013.01)

(58) Field of Classification Search
USPC ..... 335/16, 147, 195
See application file for complete search history.

(56) References Cited

U.S. PATENT DOCUMENTS

| | | | | |
|---|---|---|---|---|
| 8,841,979 | B2 * | 9/2014 | Uchida | H01H 50/546 335/195 |
| 8,981,883 | B2 * | 3/2015 | Naka | H01H 50/546 335/196 |
| 2013/0021121 | A1 | 1/2013 | Uchida | |
| 2013/0021122 | A1 * | 1/2013 | Uchida | H01H 1/54 335/131 |
| 2014/0035705 | A1 | 2/2014 | Uchida | |
| 2014/0062627 | A1 | 3/2014 | Naka et al. | |
| 2016/0071677 | A1 | 3/2016 | Neuhaus | |
| 2017/0301497 | A1 | 10/2017 | Tanaka et al. | |

FOREIGN PATENT DOCUMENTS

| | | | |
|---|---|---|---|
| CN | 105247643 | A | 1/2016 |
| CN | 106575589 | A | 4/2017 |
| JP | 2012-243584 | A | 12/2012 |

* cited by examiner

RELAY

CROSS-REFERENCE TO RELATED APPLICATION

This application claims priority to Japanese Patent Application No. 2018-068869 filed with the Japan Patent Office on Mar. 30, 2018, the entire contents of which are incorporated herein by reference.

BACKGROUND

Field

The present invention relates to a relay.

Related Art

A relay is provided with a movable touch piece including a movable contact, and a fixed touch piece including a fixed contact. The movable touch piece operates and the movable contact comes in contact with or separates from the fixed contact so that the contacts are opened and closed. Here, an electromagnetic repulsive force due to the Lorentz force is generated in the movable contact and the fixed contact by a current flowing through the movable contact and the fixed contact. This electromagnetic repulsive force acts in a direction to separate the movable contact and the fixed contact. Thus, when an overcurrent is applied, the electromagnetic repulsive force becomes strong, so that contact pressure between the contacts may decrease.

Hence there has hitherto been a relay in which an electromagnetic repulsive force is generated in the direction of pushing the movable contact toward a fixed terminal by providing a portion where currents flow in mutually opposite directions in the movable touch piece and the fixed touch piece. This enables prevention of a decrease in contact pressure between the movable contact and the fixed contact even when an overcurrent is applied.

For example, as illustrated in FIG. 13, an electromagnetic contactor described in Japanese Unexamined Patent Publication No. 2012-243584 includes a movable touch piece 101, a first fixed touch piece 102, and a second fixed touch piece 103. The movable touch piece 101 includes a first movable contact 104 and a second movable contact 105. The first fixed touch piece 102 includes a first fixed contact 106. The second fixed touch piece 103 includes a second fixed contact 107. When the movable touch piece 101 operates, the first movable contact 104 comes into contact with the first fixed contact 106 and the second movable contact 105 comes into contact with the second fixed contact 107, so that a current I flows through the first fixed touch piece 102, the movable touch piece 101, and the second fixed touch piece 103.

In addition, the first fixed touch piece 102 has a C-shaped portion 108. Hence the first fixed touch piece 102 and the movable touch piece 101 have a section in which the directions of the current I are reversed. In this section, electromagnetic repulsive forces in directions repelling each other are generated by the Lorentz force in the first fixed touch piece 102 and the movable touch piece 101. The electromagnetic repulsive force thus acts in a direction in which the first movable contact 104 is pressed against the first fixed contact 106, thereby increasing the contact pressure between the first movable contact 104 and the first fixed contact 106.

Similarly, the second fixed touch piece 103 has a C-shaped portion 109. The electromagnetic repulsive force is thus generated also in the second fixed touch piece 103 and the movable touch piece 101 in a direction in which the second movable contact 105 is pressed against the second fixed contact 107, thereby increasing the contact pressure between the second movable contact 105 and the second fixed contact 107.

However, a current has the property of flowing through the shortest path. Therefore, in the electromagnetic contactor described in Japanese Unexamined Patent Publication No. 2012-243584, as illustrated in FIG. 13, the current I does not flow to the end portions 110, 111 of the C-shaped portions 108, 109, but only partially flows through the C-shaped portions 108, 109. The electromagnetic repulsive force due to the Lorentz force is thus generated only at both end peripheral portions of the movable touch piece 101. Hence the contact pressure between the contacts might decrease.

SUMMARY

One or more embodiments of the present invention prevents a decrease in contact pressure between contacts in a relay.

A relay according to one aspect is provided with a case, a first fixed terminal, a second fixed terminal, and a movable touch piece. The first fixed terminal includes a first fixed contact. The second fixed terminal includes a second fixed contact. The movable touch piece includes a first movable contact and a second movable contact. The first movable contact is disposed facing the first fixed contact. The second movable contact is disposed facing the second fixed contact. The movable touch piece is disposed in the case and disposed so as to be movable in a contact direction in which the first movable contact and the second movable contact come into contact with the first fixed contact and the second fixed contact and in a separation direction in which the first movable contact and the second movable contact separate from the first fixed contact and the second fixed contact.

The first fixed terminal includes a first contact support, a first extension, and a first external connection. The first contact support supports the first fixed contact. The first extension extends in a first direction from the first movable contact to the second movable contact. The first external connection is connected to the first extension and protrudes in the first direction from the case.

The second fixed terminal includes a second contact support, a second extension, and a second external connection. The second contact support supports the second fixed contact. The second extension extends in a second direction from the second movable contact to the first movable contact. The second external connection is connected to the second extension and protrudes in the second direction from the case. At least a part of the first extension overlaps with the movable touch piece as viewed in the movement direction of the movable touch piece.

In the relay according to the present aspect, the first extension extends in the first direction from the first movable contact to the second movable contact, and the first external connection connected to the first extension protrudes in the first direction from the case. Hence in the first fixed terminal, it is possible to ensure a large section in which a current flows in a direction opposite to that of the movable touch piece. This enables an increase in electromagnetic repulsive force acting on the movable touch piece. At least a part of the first extension overlaps with the movable touch piece as viewed in the movement direction of the movable touch piece. It is thus possible to further increase the electromagnetic repulsive force acting on the movable touch piece.

The second extension extends in the second direction from the second movable contact to the first movable contact, and the second external connection connected to the second extension extends in the second direction from the case. Hence in the second fixed terminal, it is possible to ensure a large section in which a current flows in a direction opposite to that of the movable touch piece. Accordingly, the electromagnetic repulsive force acting on the movable touch piece can be further increased by the electromagnetic repulsive force generated between the second extension and the movable touch piece. This can increase the contact pressure between the first movable contact and the first fixed contact and the contact pressure between the second movable contact and the second fixed contact.

Further, the first external connection and the second external connection protrude in mutually opposite directions from the case. This facilitates connecting the first external connection and the second external connection to an external circuit, as compared with a configuration where the first external connection and the second external connection protrude in the same direction.

At least a part of the second extension may overlap with the movable touch piece as viewed in the movement direction of the movable touch piece. In this instance, it is possible to further increase the electromagnetic repulsive force generated between the second extension and the movable touch piece. This can further increase the contact pressure between the first movable contact and the first fixed contact and the contact pressure between the second movable contact and the second fixed contact.

The first extension and the second extension may be arranged symmetrically with respect to a center line of the movable touch piece extending in the movement direction of the movable touch piece. In this instance, the electromagnetic repulsive force by the first extension and the electromagnetic repulsive force by the second extension can equally act on the movable touch piece. Hence it is possible to improve contact stability between the contacts.

The first external connection and the second external connection may be disposed to be flush with each other. In this instance, connecting the first external connection and the second external connection to the external circuit is further facilitated The first fixed terminal may include an intermediate portion having a shape folded back from the first contact support toward the first extension The case may include a partition disposed between the intermediate portion and the second external connection. The partition may be formed of an insulating material. In this instance, even when the intermediate portion and the second external connection are disposed close to each other, the partition can improve the insulation between the intermediate portion and the second external connection.

The partition may include a division wall and a support. The division wall may be disposed between the intermediate portion and the second external connection. The support may be disposed facing the intermediate portion and support the intermediate portion. In this instance, the partition can serve as a holding structure of the intermediate portion as well as the insulating structure between the intermediate portion and the second external connection.

The first extension and the second extension may be disposed outside the case along the outer surface of the case. In this instance, the first extension and the second extension can be easily attached to the case.

The case may include a protrusion disposed between the first extension and the second extension and protruding from the outer surface. The protrusion may be formed of an insulating material. In this instance, the insulation between the first extension and the second extension can be improved.

The first extension and the second extension may be embedded in the case. In this instance, the first extension and the second extension are protected easily. In addition, the insulation between the first extension and the second extension can be improved.

The first extension and the second extension may be disposed in a housing space in the case. In this instance, the first extension and the second extension are protected easily.

According to the present invention, by increasing the electromagnetic repulsive force in a direction to press the movable contact against the fixed contact, it is possible to prevent a decrease in contact pressure between the contacts.

DETAILED DESCRIPTION

Figure 1:
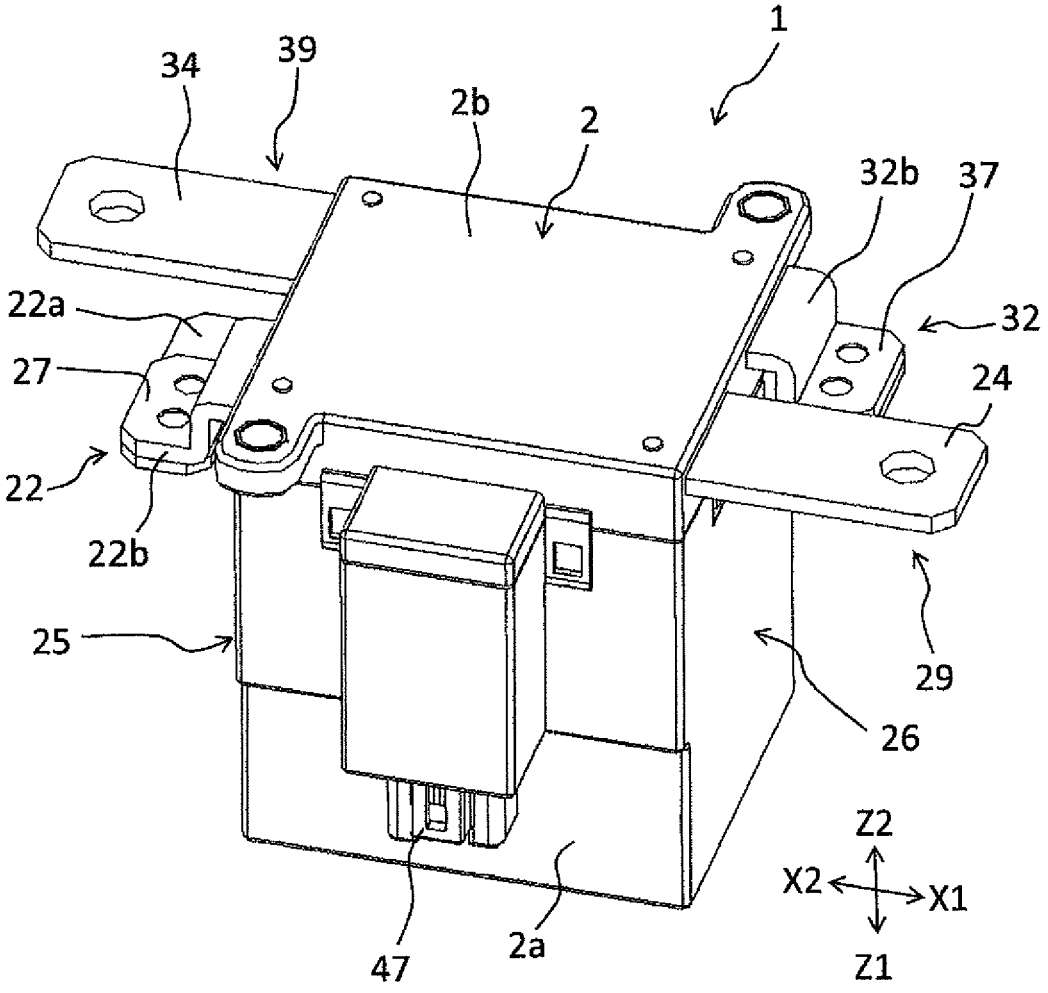
FIG. 1 is a perspective view of a relay according to an embodiment.
Figure 2:
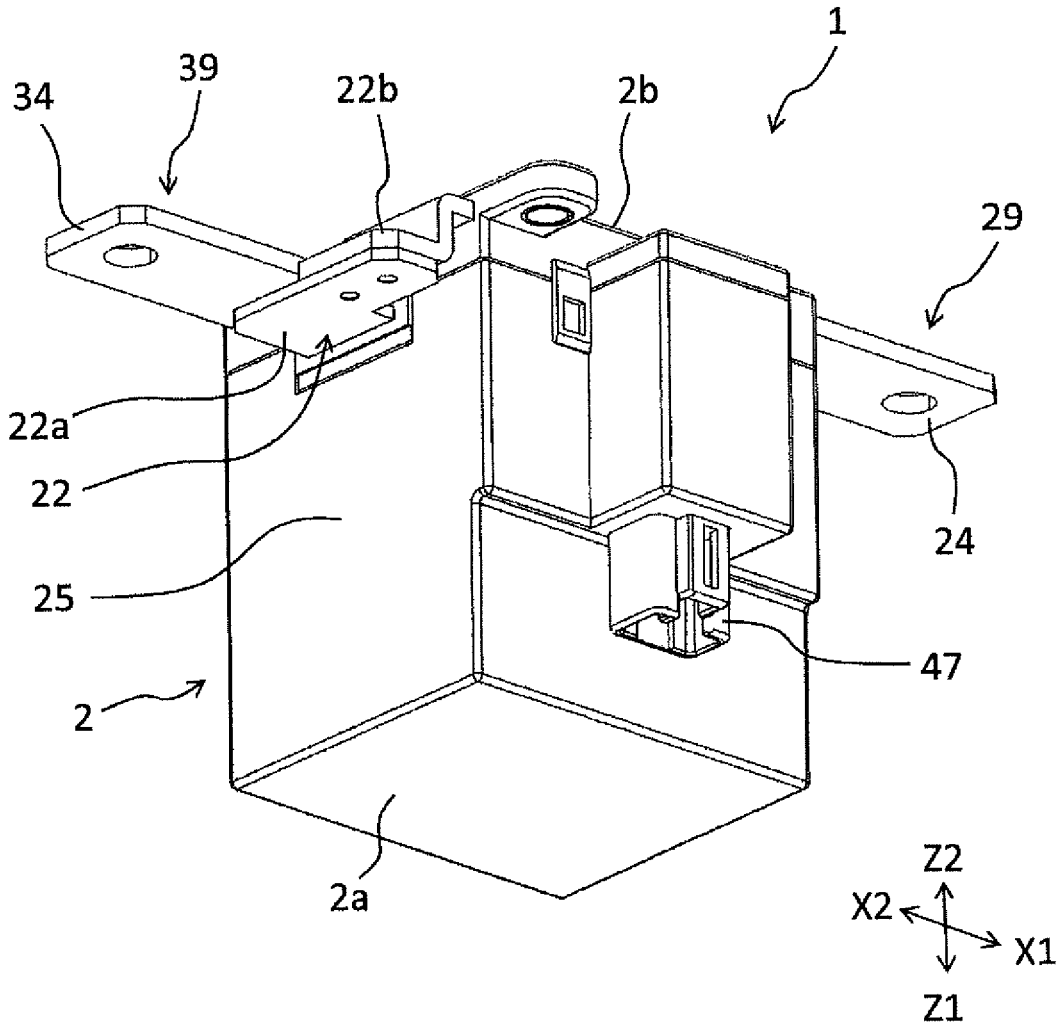
FIG. 2 is a perspective view of the relay.
Figure 3:
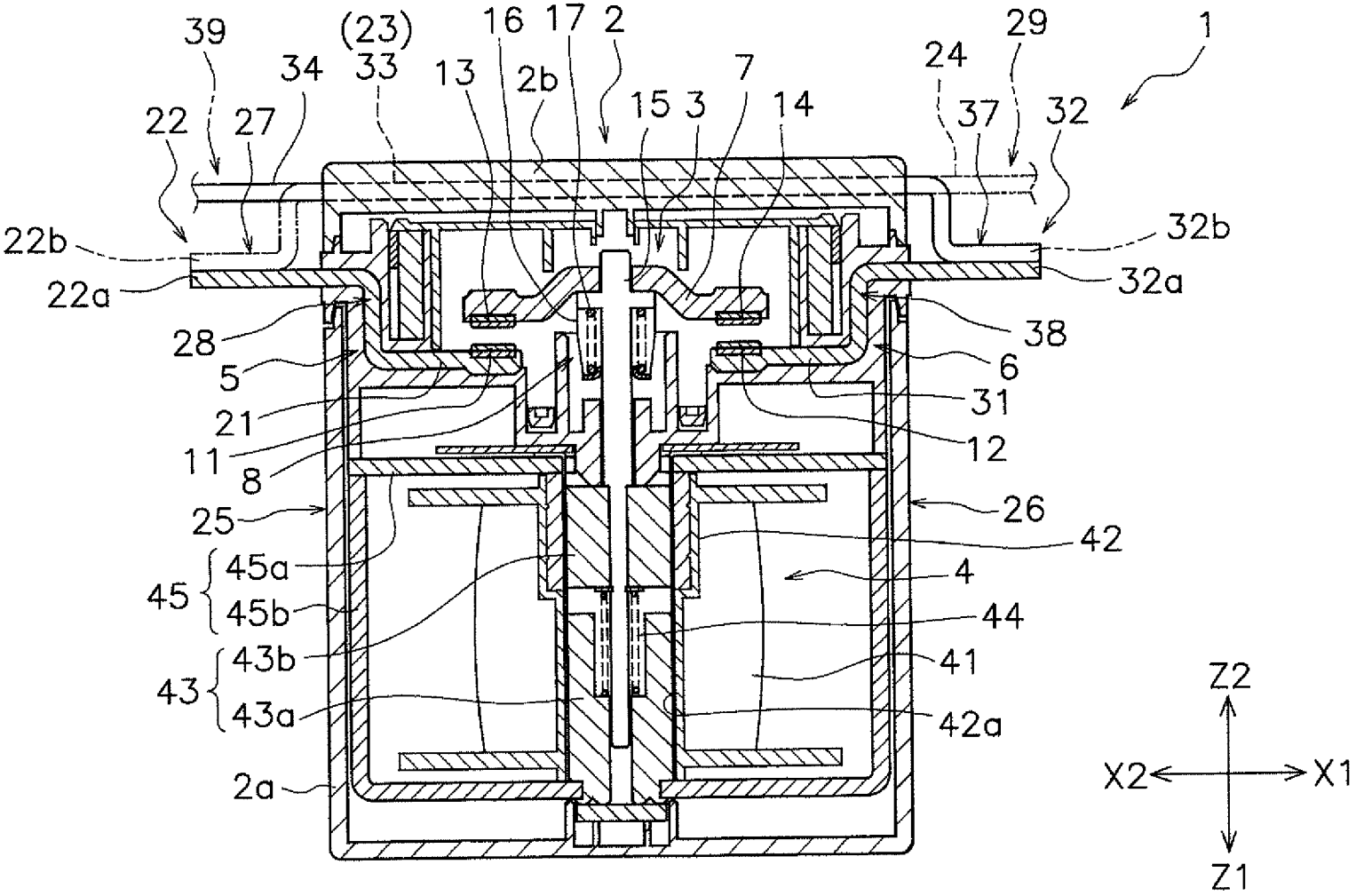
FIG. 3 is a sectional view of the relay.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIGS. 1 and 2 are perspective views illustrating a relay 1 according to one or more embodiments of the present invention. FIG. 3 is a sectional view of the relay 1. As illustrated in FIG. 3, the relay 1 includes a case 2, a contact device 3, and a drive device 4.

The case 2 accommodates the contact device 3 and the drive device 4. The case 2 is formed of a resin having insulation. The case 2 includes a case body 2*a* and a lid portion 2*b*. The contact device 3 and the drive device 4 are disposed in the case body 2*a*. The lid portion 2*b* is separate from the case body 2*a*. The lid portion 2*b* is attached to the case body 2*a*.

The contact device 3 includes a first fixed terminal 5, a second fixed terminal 6, a movable touch piece 7, and a touch piece holding portion 8. The first fixed terminal 5, the second fixed terminal 6, and the movable touch piece 7 are formed of a material having conductivity. The first fixed terminal 5 includes a first fixed contact 11. The second fixed terminal 6 includes a second fixed contact 12. The first fixed contact 11 and the second fixed contact 12 are spaced apart from each other in a longitudinal direction of the movable touch piece 7 (a right-left direction in FIG. 3).

The movable touch piece 7 includes a first movable contact 13 and a second movable contact 14. The first movable contact 13 is disposed facing the first fixed contact 11. The second movable contact 14 is disposed facing the second fixed contact 12. The movable touch piece 7 is disposed movably in a contact direction (Z1) and a separation direction (Z2).

The contact direction (Z1) is a direction (downward in FIG. 3) in which the first movable contact 13 and the second movable contact 14 come into contact with the first fixed contact 11 and the second fixed contact 12. The separation direction (Z2) is a direction (upward in FIG. 3) in which the first movable contact 13 and the second movable contact 14 separate from the first fixed contact 11 and the second fixed contact 12. In the following description, a direction from the first movable contact 13 to the second movable contact 14 (rightward in FIG. 3) is referred to as a "first direction (X1)." A direction from the second movable contact 14 to the first movable contact 13 (leftward in FIG. 3) is referred to as a "second direction (X2)."

The touch piece holding portion 8 holds the movable touch piece 7. The touch piece holding portion 8 includes a drive shaft 15, a holder 16, and a contact spring 17. The drive shaft 15 extends in a movement direction (Z1, Z2) of the movable touch piece 7. The drive shaft 15 is disposed movably in the contact direction (Z1) and the separation direction (Z2). The holder 16 is connected to the movable touch piece 7 and holds the movable touch piece 7. The contact spring 17 is disposed between the drive shaft 15 and the holder 16.

The first fixed terminal 5 includes a first contact support 21, a first intermediate portion 22, a first extension 23, and a first external connection 24. The first contact support 21 supports the first fixed contact 11. The first contact support 21 extends in the second direction (X2) from the first fixed contact 11 in the case 2.

The first intermediate portion 22 connects the first contact support 21 and the first extension 23. At least a part of the first intermediate portion 22 is disposed so as to be exposed to the outside of the case 2. The case 2 includes a first outer side surface 25 and a second outer side surface 26. The first outer side surface 25 and the second outer side surface 26 extend in the movement direction (Z1, Z2) of the movable touch piece 7. The first intermediate portion 22 protrudes in the second direction (X2) from the first outer side surface 25 of the case 2. That is, the first intermediate portion 22 is exposed to the outside from the first outer side surface 25 of the case 2.

The first intermediate portion 22 has a shape folded from the first contact support 21 toward the first extension 23. The first intermediate portion 22 includes a first flat surface 27. The first flat surface 27 is disposed so as to be exposed to the outside of the case 2. The first flat surface 27 is disposed parallel to the first external connection 24. The first flat surface 27 extends in the second direction (X2) from the first outer side surface 25 of the case 2.

The first extension 23 is disposed apart from the movable touch piece 7 in the separation direction (Z2). The first extension 23 has a flat plate shape. The first extension 23 extends in the first direction (X1). The first extension 23 extends in the first direction (X1) from the first intermediate portion 22 to a position beyond the first fixed contact 11 and the second fixed contact 12. The first extension 23 extends over the entire width of the case 2 in the first direction (X1).

The first external connection 24 is connected to the first extension 23 and protrudes in the first direction (X1) from the second outer side surface 26 of the case 2. The first external connection 24 is a portion to be connected to an external circuit to which the relay 1 is attached. The first external connection 24 is formed integrally with the first extension 23. However, the first external connection 24 may be separate from the first extension 23. The first external connection 24 has a flat plate shape.

In the present embodiment, the first fixed terminal 5 includes a first fixed touch piece 28 and a first bus bar 29. The first bus bar 29 and the first fixed touch piece 28 are separate from each other. The first bus bar 29 is connected to the first fixed touch piece 28. The first fixed touch piece 28 extends in the second direction (X2) from the first fixed contact 11. An end portion of the first fixed touch piece 28 protrudes outward of the case 2. The end portion of the first fixed touch piece 28 is connected to the first bus bar 29 outside the case 2.

The first fixed touch piece 28 is connected to the first bus bar 29 by welding, for example. However, the first fixed touch piece 28 may be connected to the first bus bar 29 by another fixing method. For example, the first fixed touch piece 28 may be connected to the first bus bar 29 by screws. Alternatively, the first fixed touch piece 28 may be formed integrally with the first bus bar 29.

The first fixed touch piece 28 includes the first contact support 21 described above. The first bus bar 29 includes the first extension 23 and the first external connection 24 described above. The first intermediate portion 22 includes a first attachment portion 22*a* included in the first fixed touch piece 28 and a second attachment portion 22*b* included in the first bus bar 29. The first attachment portion 22*a* is formed integrally with the first contact support 21 in the first fixed touch piece 28. The second attachment portion 22*b* is formed integrally with the first extension 23 in the first bus bar 29. However, the first attachment portion 22*a* may be separate from the first contact support 21. The second attachment portion 22*b* may be separate from the first extension 23. The first attachment portion 22*a* and the second attachment portion 22*b* are disposed so as to be exposed to the outside of the case 2.

As illustrated in FIG. 2, the first attachment portion 22*a* has a shape bent toward the first bus bar 29. The second attachment portion 22*b* has a shape bent from the first attachment portion 22*a* toward the first extension 23. The second attachment portion 22*b* is connected to the first attachment portion 22*a*. For example, the second attachment portion 22*b* is connected to the first attachment portion 22*a* by welding. However, the second attachment portion 22*b* may be connected to the first attachment portion 22*a* by another fixing method. For example, the second attachment portion 22*b* may be connected to the first attachment portion 22*a* by screws.

The second fixed terminal 6 has a shape symmetrical with the first fixed terminal 5. The second fixed terminal 6 includes a second contact support 31, a second intermediate portion 32, a second extension 33, and a second external connection 34. The second contact support 31 supports the second fixed contact 12. The second contact support 31 extends in the first direction (X1) from the second fixed contact 12 in the case 2.

The second intermediate portion 32 connects the second contact support 31 and the second extension 33. At least a part of the second intermediate portion 32 is disposed so as to be exposed to the outside of the case 2. The second intermediate portion 32 protrudes in the first direction (X1) from the second outer side surface 26 of the case 2. That is, the second intermediate portion 32 is exposed to the outside from the second outer side surface 26 of the case 2.

The second intermediate portion 32 has a shape folded back from the second contact support 31 toward the second extension 33. The second intermediate portion 32 includes a second flat surface 37. The second flat surface 37 is disposed so as to be exposed to the outside of the case 2. The second flat surface 37 is disposed parallel to the second external connection 34. The second flat surface 37 extends in the first direction (X1) from the second outer side surface 26 of the case 2.

The second extension 33 is disposed apart from the movable touch piece 7 in the separation direction (Z2). The second extension 33 has a flat plate shape. The second extension 33 extends in the second direction (X2). The second extension 33 extends in a second direction (X2) from the second intermediate portion 32 to a position beyond the second fixed contact 12 and the first fixed contact 11. The second extension 33 extends over the entire width of the case 2 in the second direction (X2).

The second external connection 34 is connected to the second extension 33 and protrudes in the second direction (X2) from the first outer side surface 25 of the case 2. The second external connection 34 is a portion connected to the external circuit. The second external connection 34 is formed integrally with the second extension 33. However, the second external connection 34 may be separate from the second extension 33. The second external connection 34 has a flat plate shape.

In the present embodiment, the second fixed terminal 6 includes a second fixed touch piece 38 and a second bus bar 39. The second bus bar 39 is separate from the second fixed touch piece 38. The second bus bar 39 is connected to the second fixed touch piece 38. The second fixed touch piece 38 extends in the first direction (X1) from the second fixed contact 12. An end portion of the second fixed touch piece 38 protrudes outward of the case 2. The end portion of the second fixed touch piece 38 is connected to the second bus bar 39 outside the case 2.

The second fixed touch piece 38 is connected to the second bus bar 39 by welding, for example. However, the second fixed touch piece 38 may be connected to the second bus bar 39 by another fixing method. For example, the second fixed touch piece 38 may be connected to the second bus bar 39 by screws. Alternatively, the second fixed touch piece 38 may be formed integrally with the second bus bar 39.

The second fixed touch piece 38 includes the second contact support 31 described above. The second bus bar 39 includes the second extension 33 and the second external connection 34. The second intermediate portion 32 includes a first attachment portion 32*a* included in the second fixed touch piece 38 and a second attachment portion 32*b* included in the second bus bar 39. The first attachment portion 32*a* is formed integrally with the second contact support 31 in the second fixed touch piece 38. The second attachment portion 32*b* is formed integrally with the second extension 33 in the second bus bar 39. However, the first attachment portion 32*a* may be separate from the second contact support 31. The second attachment portion 32*b* may be separate from the second extension 33. The first attachment portion 32*a* and the second attachment portion 32*b* are disposed so as to be exposed to the outside of the case 2.

The first attachment portion 32*a* has a shape bent toward the second bus bar 39. The first attachment portion 32*a* is connected to the second attachment portion 32*b*. The second attachment portion 32*b* has a shape bent from the first attachment portion 32*a* toward the second extension 33. For example, the first attachment portion 32*a* is connected to the second attachment portion 32*b* by welding. However, the first attachment portion 32*a* may be connected to the second attachment portion 32*b* by another fixing method. For example, the first attachment portion 32*a* may be connected to the second attachment portion 32*b* by screws.

Figure 5:
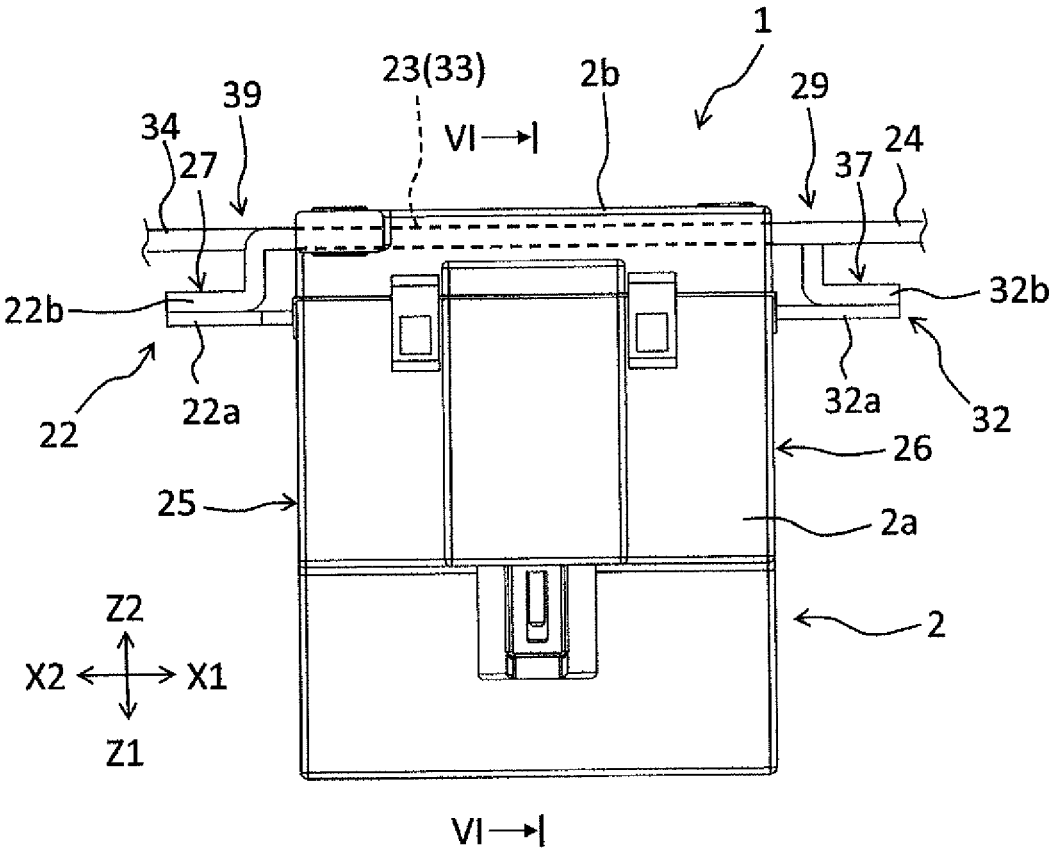
FIG. 5 is a front view of the relay.
Figure 6:
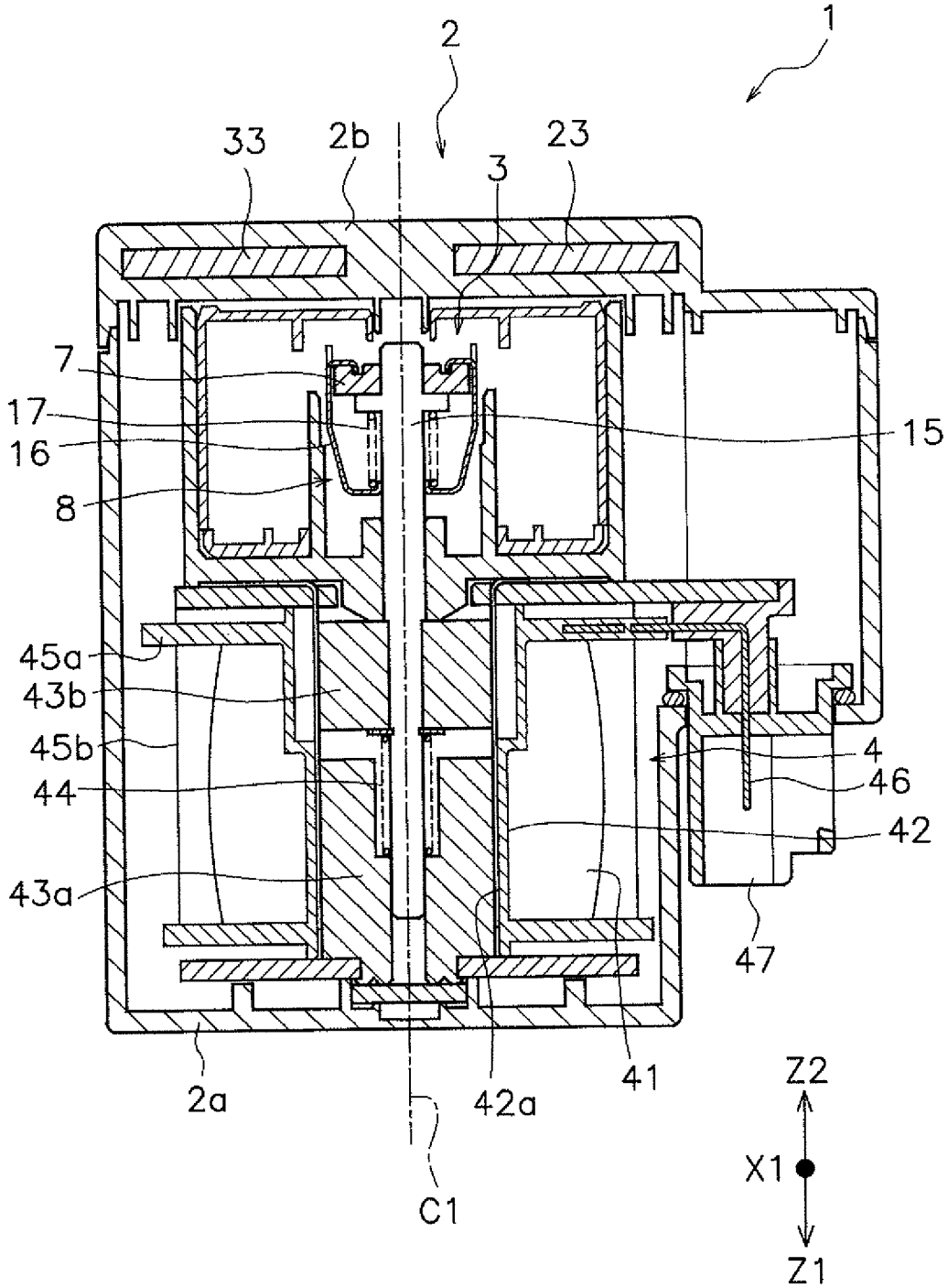
FIG. 6 is a sectional view taken along a line VI-VI in FIG. 5.

FIG. 6 is a sectional view taken along a line VI-VI in FIG. 5. As illustrated in FIG. 6, the first extension 23 and the second extension 33 are embedded in the case 2. Specifically, the first extension 23 and the second extension 33 are embedded in the lid portion 2*b*. The first extension 23 and the second extension 33 are arranged symmetrically with respect to a center line C1 of the movable touch piece 7 extending in the movement direction (Z1, Z2) of the movable touch piece 7.

Figure 4:
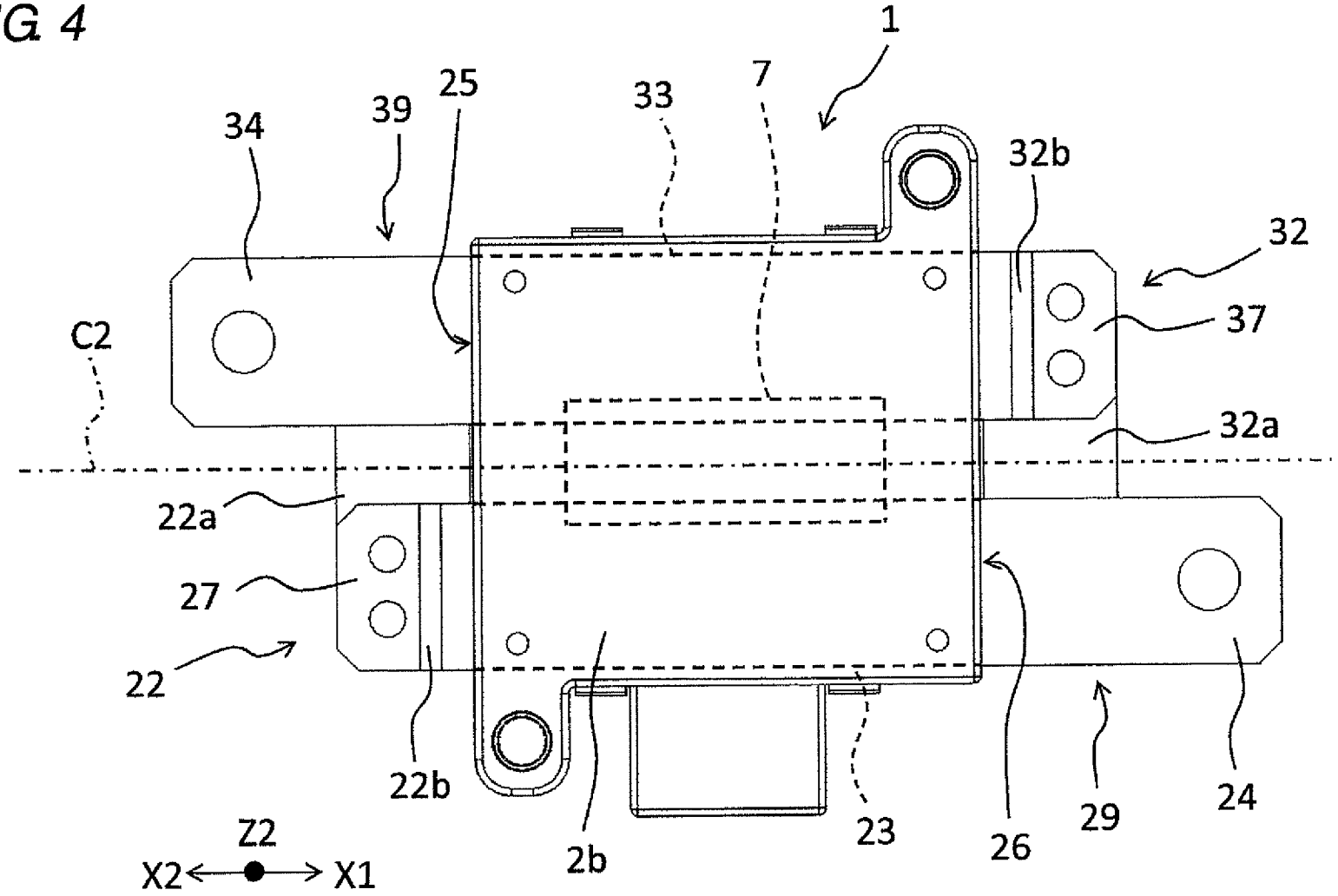
FIG. 4 is a plan view of the relay.

As illustrated in FIG. 4, the first extension 23 and the second extension 33 are arranged symmetrically with respect to a center line C2 of the movable touch piece 7 extending in the longitudinal direction of the movable touch piece 7. A part of the first extension 23 overlaps with the movable touch piece 7 as viewed in the movement direction (Z1, Z2) of the movable touch piece 7. A part of the second extension 33 overlaps with the movable touch piece 7 as viewed in the movement direction (Z1, Z2) of the movable touch piece 7. As viewed in the movement direction (Z1, Z2) of the movable touch piece 7, the range where the first extension 23 overlaps with the movable touch piece 7 has the same size as the range where the second extension 33 overlaps with the movable touch piece 7.

The first extension 23 and the second extension 33 are disposed at the same height with the movement direction (Z1, Z2) of the movable touch piece 7 as a height direction. The first extension 23 and the second extension 33 are disposed to be flush with each other. The first external connection 24 and the second external connection 34 are disposed at the same height with the movement direction (Z1, Z2) of the movable touch piece 7 as the height direction. The first external connection 24 and the second external connection 34 are disposed to be flush with each other. The first flat surface 27 and the second flat surface 37 are disposed at the same height with the movement direction (Z1, Z2) of the movable touch piece 7 as the height direction. The first flat surface 27 and the second flat surface 37 are disposed to be flush with each other.

Next, the drive device 4 will be described. The drive device 4 generates a driving force for operating the movable touch piece 7. The drive device 4 operates the movable touch piece 7 by an electromagnetic force. The drive device 4 includes a coil 41, a spool 42, a core 43, a return spring 44, and a yoke 45.

The coil 41 is wound around the spool 42. The coil 41 and the spool 42 are disposed coaxially with the drive shaft 15. The coil 41 is connected to the coil terminal 46 illustrated in FIG. 6. As illustrated in FIG. 6, the leading end of the coil terminal 46 is disposed in a connector 47.

The spool 42 includes a hole 42*a* penetrating in an axial direction of the spool 42. The iron core 43 and the return spring 44 are inserted into a hole 42*a* of the spool 42. The iron core 43 includes a fixed iron core 43*a* and a movable iron core 43*b*. The fixed iron core 43*a* is fixed to a second yoke 45*b*, the spool 42, or the case 2. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* has a U-shape. The second yoke 45*b* is disposed on each side of the coil 41 and on the side opposite to the first yoke 45*a* with respect to the coil 41. The first yoke 45*a* is connected to one end of the iron core 43. The second yoke 45*b* is connected to the other end of the iron core 43.

The iron core 43 includes a fixed iron core 43*a* and a movable iron core 43*b*. The fixed iron core 43*a* is fixed to the second yoke 45*b*. The movable iron core 43*b* is separate from the fixed iron core 43*a*. The movable iron core 43*b* is disposed movably in the contact direction (Z1) and the separation direction (Z2). The movable iron core 43*b* is connected to the drive shaft 15. The return spring 44 is disposed between the movable iron core 43*b* and the fixed iron core 43*a*. The return spring 44 urges the movable iron core 43*b* in the separation direction (Z2).

Next, the operation of the relay 1 will be described. When no voltage is applied to the coil 41, the drive shaft 15 is pressed, together with the movable iron core 43*b*, in the separation direction (Z2) by an elastic force of the return spring 44. Therefore, the movable touch piece 7 is also pressed in the separation direction (Z2), and the first movable contact 13 and the second movable contact 14 are in an open state, being separated from the first fixed contact 11 and the second fixed contact 12.

When a voltage is applied to the coil 41 and excited, the movable iron core 43*b* moves in the contact direction (Z1) against the elastic force of the return spring 44. Thus, by movement of the drive shaft 15 and the movable touch piece 7 in the contact direction (Z1), the first movable contact 13 and the second movable contact 14 are brought into a closed state, being in contact with the first fixed contact 11 and the second fixed contact 12. In this closed state, a current flows from the first fixed terminal 5 to the second fixed terminal 6 through the movable touch piece 7.

Figure 7:
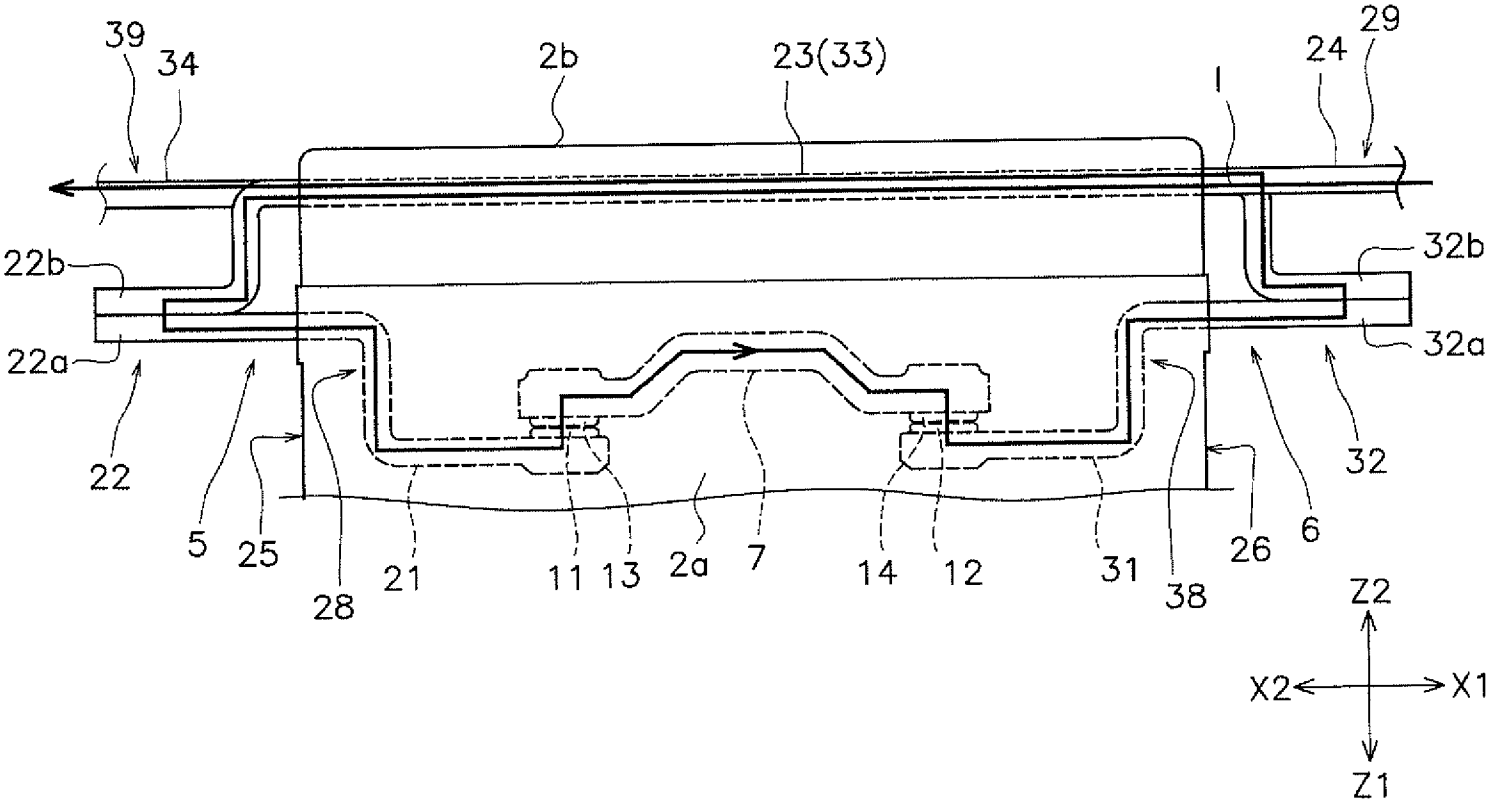
FIG. 7 is a schematic diagram illustrating a current flow in the relay in a closed state.

FIG. 7 is a diagram illustrating the flow of the current I in the closed state. As illustrated in FIG. 7, the current I flows from the first external connection 24 to the movable touch piece 7 through the first extension 23, the first intermediate portion 22, the first contact support 21, the first fixed contact 11, and the first movable contact 13. The current I passes from the movable touch piece 7 through the second movable contact 14, the second fixed contact 12, the second contact support 31, the second intermediate portion 32, and the second extension 33, and the second external connection 34.

In the relay 1 according to the present embodiment, the first extension 23 extends in a first direction (X1) from the first movable contact 13 to the second movable contact 14, and the first external connection 24 connected to the first extension 23 protrudes in the first direction (X1) from the case 2. The current I flows in the first extension 23 in a direction opposite to that of the movable touch piece 7. Hence in the first fixed terminal 5, it is possible to ensure a large section in which the current I flows in the opposite direction to the movable touch piece 7. This enables an increase in electromagnetic repulsive force acting on the movable touch piece 7.

Further, the second extension 33 extends in the second direction (X2) from the second movable contact 14 to the first movable contact 13, and the second external connection 34 connected to the second extension 33 protrudes in the second direction (X2) from the case 2. A current I flows in the second extension 33 in a direction opposite to that of the movable touch piece 7. Therefore, in the second fixed terminal 6, it is possible to ensure a large section in which the current I flows in the opposite direction to the movable touch piece 7. Thereby, the electromagnetic repulsive force acting on the movable touch piece 7 can be further increased.

As described above, in the relay according to the present embodiment, a current flows in the first extension 23 and the second extension 33 in a direction opposite to that of the movable touch piece 7, thereby acting on the movable touch piece 7 The electromagnetic repulsive force can be increased. This can increase the contact pressure between the first movable contact 13 and the first fixed contact 11 and the contact pressure between the second movable contact 14 and the second fixed contact 12.

Since the electromagnetic repulsive force can be sufficiently increased by the first extension 23 and the second extension 33, even when the space between the first bus bar 29 and the second bus bar 39 and the movable touch piece is widened, sufficient contact pressure between the contacts can be ensured. Therefore, it is easy to ensure a space for the arc to extend when the load is cut off.

In addition, the first external connection 24 protrudes in the first direction (X1) from the case 2, and the second external connection 34 protrudes in the second direction (X2) from the case 2. Hence the first external connection 24 and the second external connection 34 protrude in mutually opposite directions from the case 2. This facilitates connecting the first external connection 24 and the second external connection 34 to the external circuit, as compared with a configuration where the first external connection 24 and the second external connection 34 protrude in the same direction.

At least a part of the first extension 23 overlaps with the movable touch piece 7 as viewed in the movement direction (Z1, Z2) of the movable touch piece 7. At least a part of the second extension 33 overlaps with the movable touch piece 7 as viewed in the movement direction (Z1, Z2) of the movable touch piece 7. Therefore, the electromagnetic repulsive force acting on the movable touch piece 7 can be further increased. This can further increase the contact pressure between the first movable contact 13 and the first fixed contact 11 and the contact pressure between the second movable contact 14 and the second fixed contact 12.

The first extension 23 and the second extension 33 are arranged symmetrically with respect to a center line C1 of the movable touch piece 7 extending in the movement direction (Z1, Z2) of the movable touch piece 7. Therefore, the electromagnetic repulsive force of the first extension 23 and the electromagnetic repulsive force of the second extension 33 can equally act on the movable touch piece 7. Hence it is possible to improve contact stability between the contacts.

The first external connection 24 and the second external connection 34 are disposed to be flush with each other. This further facilitates connecting the first external connection 24 and the second external connection 34 to the external circuit. For example, the first external connection 24 and the second external connection 34 can be easily connected to a common substrate of external circuits.

The first extension 23 and the second extension 33 are embedded in the case 2. This facilitates protecting the first extension 23 and the second extension 33. A part of the case 2 formed of an insulating resin is disposed between the first extension 23 and the second extension 33. Therefore, even when the first extension 23 and the second extension 33 are disposed close to each other, the insulation between the first extension 23 and the second extension 33 can be improved.

Although embodiments of the present invention are described the above, the present invention is not limited to the above embodiments, and various changes can be made in the scope not deviating from the gist of the present invention. For example, the configuration of the drive device 4 may be changed. The shape or placement of the coil 41, the spool 42, the iron core 43, the return spring 44, or the yoke 45 may be changed.

The shape or placement of the first fixed terminal 5, the second fixed terminal 6, and the movable touch piece 7 may be changed. For example, the placement of the first fixed terminal 5 and the second fixed terminal 6 is not limited to that of the embodiment described above, and may be interchanged.

In the above embodiment, by the drive device 4 drawing the drive shaft 15 toward the coil 41 side, the movable touch piece 7 moves in the contact direction (Z1). By the drive device 4 pushing the drive shaft 15 from the coil 41 side, the movable touch piece 7 moves in the separation direction (Z2). However, by the drive device 4 drawing the drive shaft 15 toward the coil 41 side, the movable touch piece 7 may move in the separation direction (Z2). By the drive device 4 pushing the drive shaft 15 from the coil 41 side, the movable touch piece 7 may move in the contact direction (Z1).

In the above embodiment, the first extension 23 and the second extension 33 are arranged symmetrically with respect to the center line C1 of the movable touch piece 7. However, the placement of the first extension 23 and the second extension 33 may be changed.

Figure 8:
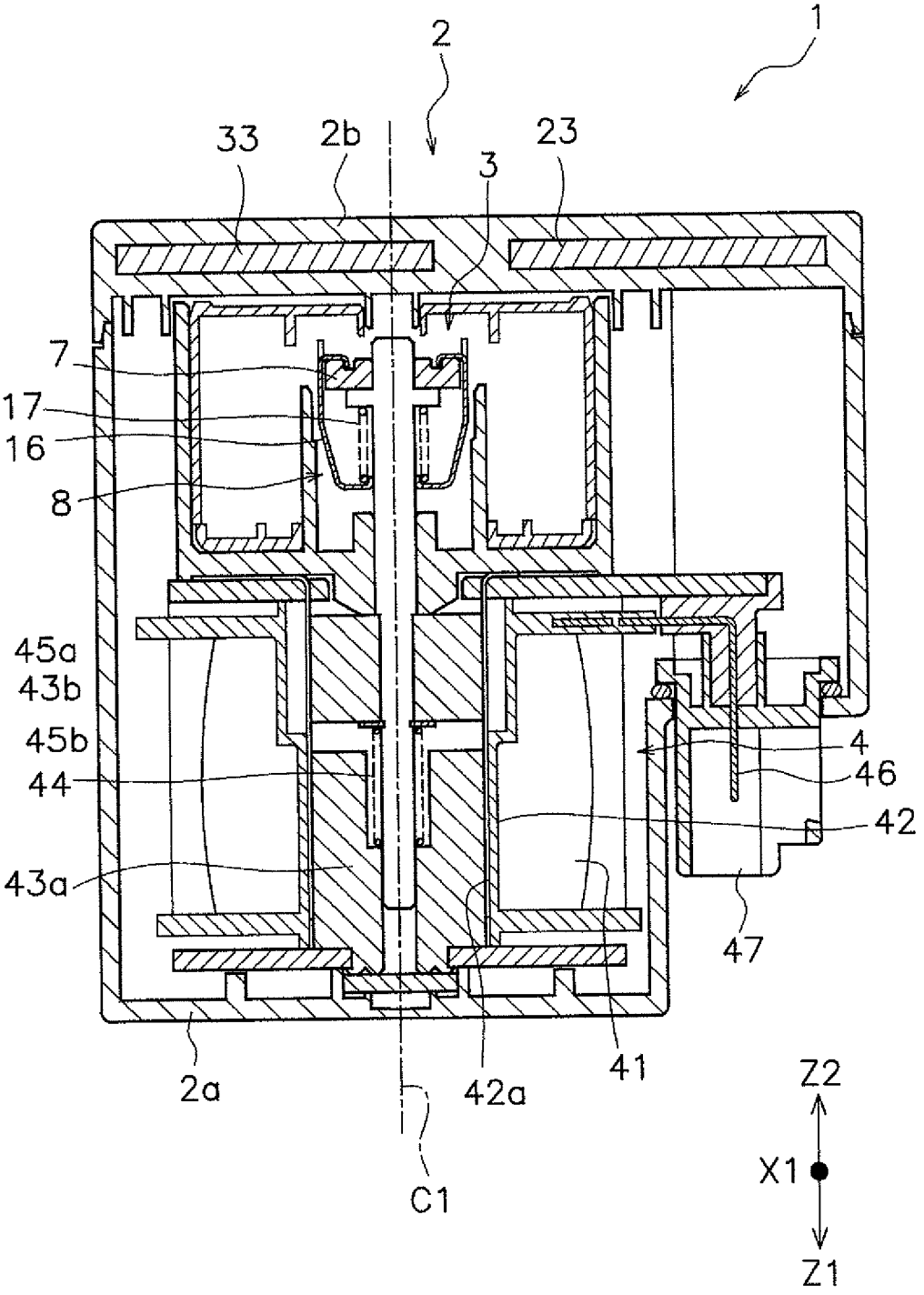
FIG. 8 is a sectional view of a relay according to a first modified example.

FIG. 8 is a sectional view of the relay 1 according to a first modified example. As illustrated in FIG. 8, the first extension 23 and the second extension 33 may be arranged asymmetrically with respect to the center line C1 of the movable touch piece 7. As viewed in the movement direction (Z1, Z2) of the movable touch piece 7, of the first extension 23 and the second extension 33, only the first extension 23 overlaps with the movable touch piece 7, and the second extension 33 may be disposed at a position not overlapping with the movable touch piece 7. As viewed in the movement direction (Z1, Z2) of the movable touch piece 7, the whole of the first extension 23 may overlap with the movable touch piece 7.

Figure 9:
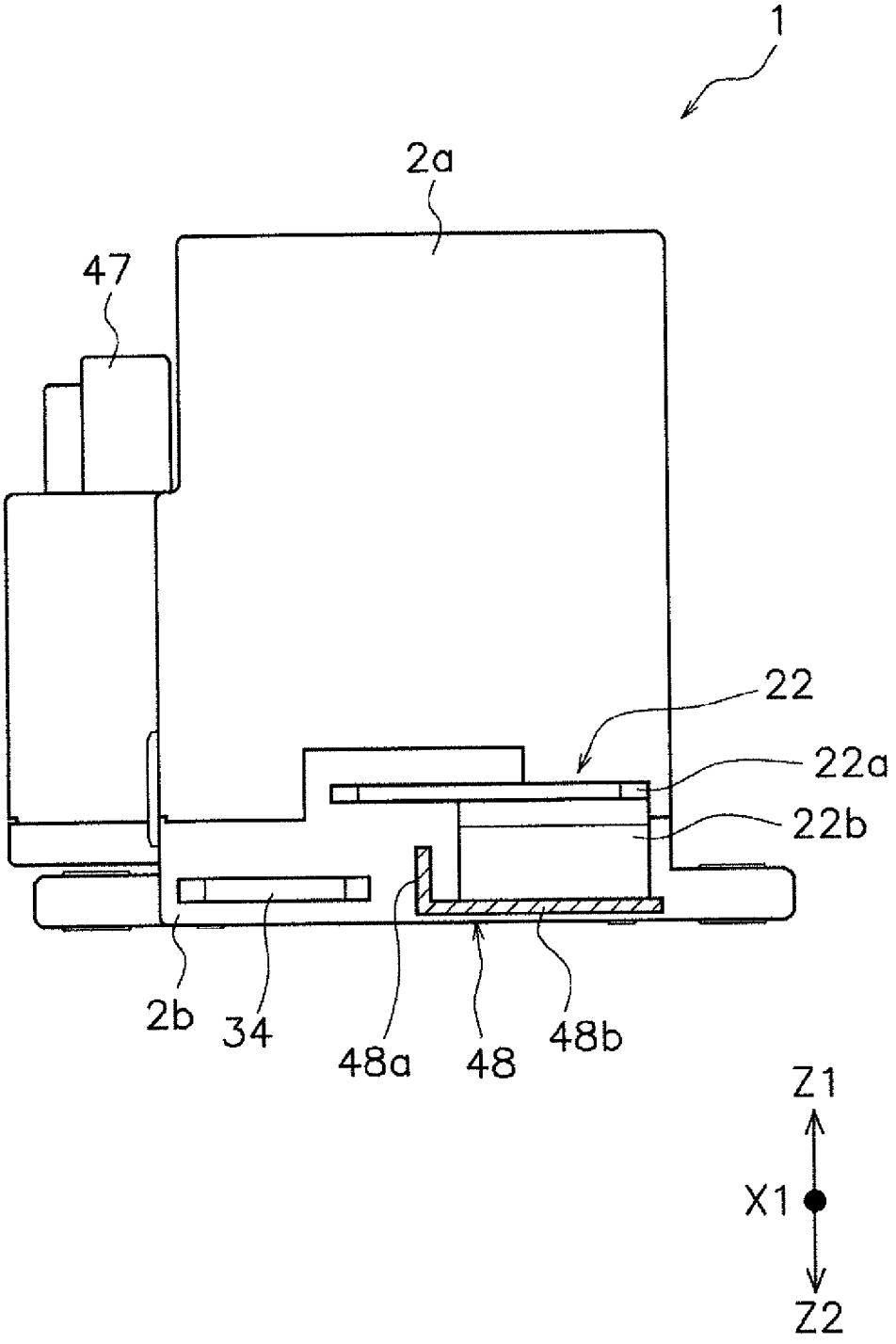
FIG. 9 is a side view of a relay according to a second modified example.

The shape or placement of the case 2 may be changed. FIG. 9 is a side view of the relay 1 according to a second modified example. As illustrated in FIG. 9, the case 2 may include a partition 48. The partition 48 is disposed between the first intermediate portion 22 and the second external connection 34. The partition 48 is formed of an insulating material. Specifically, the partition 48 includes a division wall 48*a* and a support 48*b*. The division wall 48*a* is disposed between the first intermediate portion 22 and the second external connection 34. The support 48*b* is disposed facing the first intermediate portion 22 and supports the first intermediate portion 22.

In this instance, even when the first intermediate portion 22 and the second external connection 34 are disposed close to each other, the partition 48 improves the insulation between the first intermediate portion 22 and the second external connection 34. Further, the partition 48 can also serve as the holding structure of the first intermediate portion 22 as well as the insulating structure between the first intermediate portion 22 and the second external connection 34.

In the partition 48, only the division wall 48*a* may be provided, and the support 48*b* may be omitted. Like the partition 48, a partition may be provided between the second intermediate portion 32 and the first external connection 24.

In the above embodiment, the first extension 23 and the second extension 33 are embedded in the lid portion 2*b* of the case 2. However, the first extension 23 and the second extension 33 may be embedded in other portions of the case 2. Alternatively, the first extension 23 and the second extension 33 may be disposed outside the case 2.

Figure 10A:
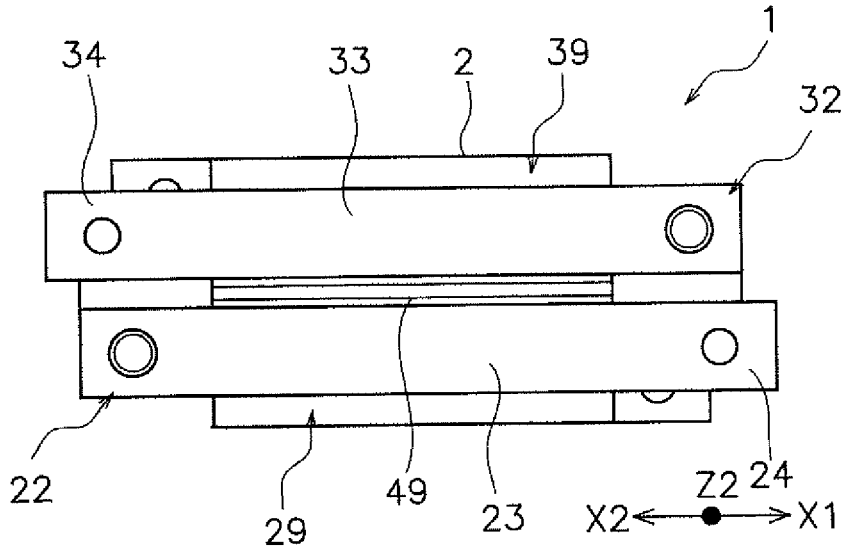
FIGS. 10A and 10B are a plan view and a front view of a relay according to a third modified example.
Figure 10B:
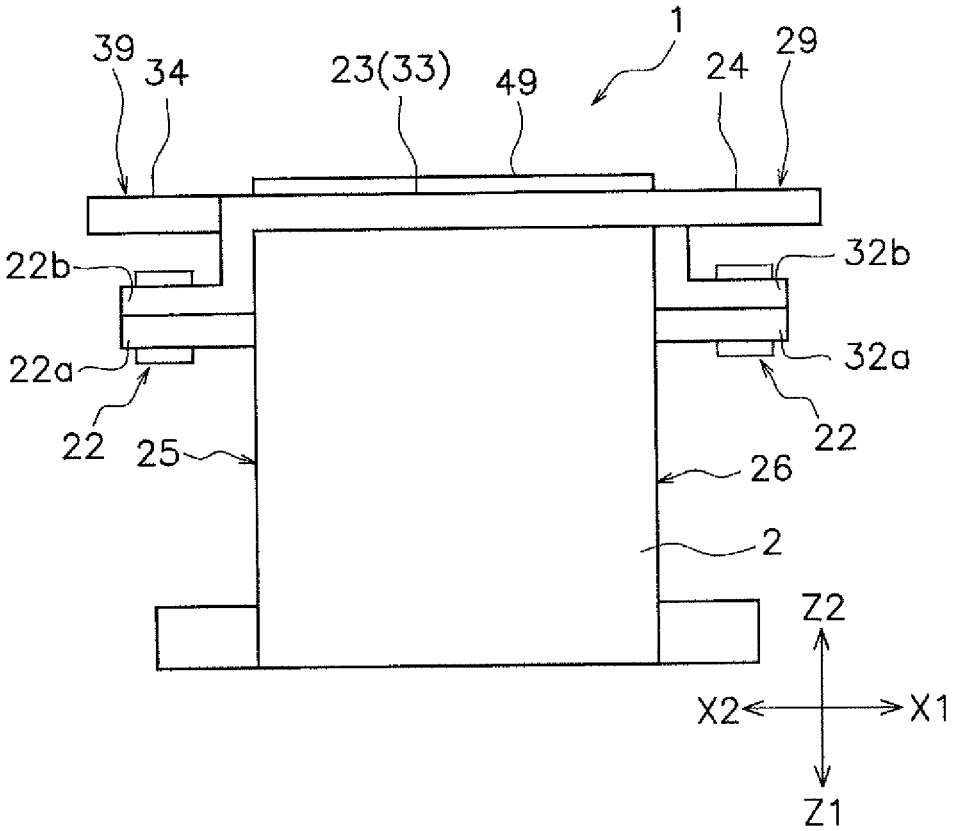
Figure 11:
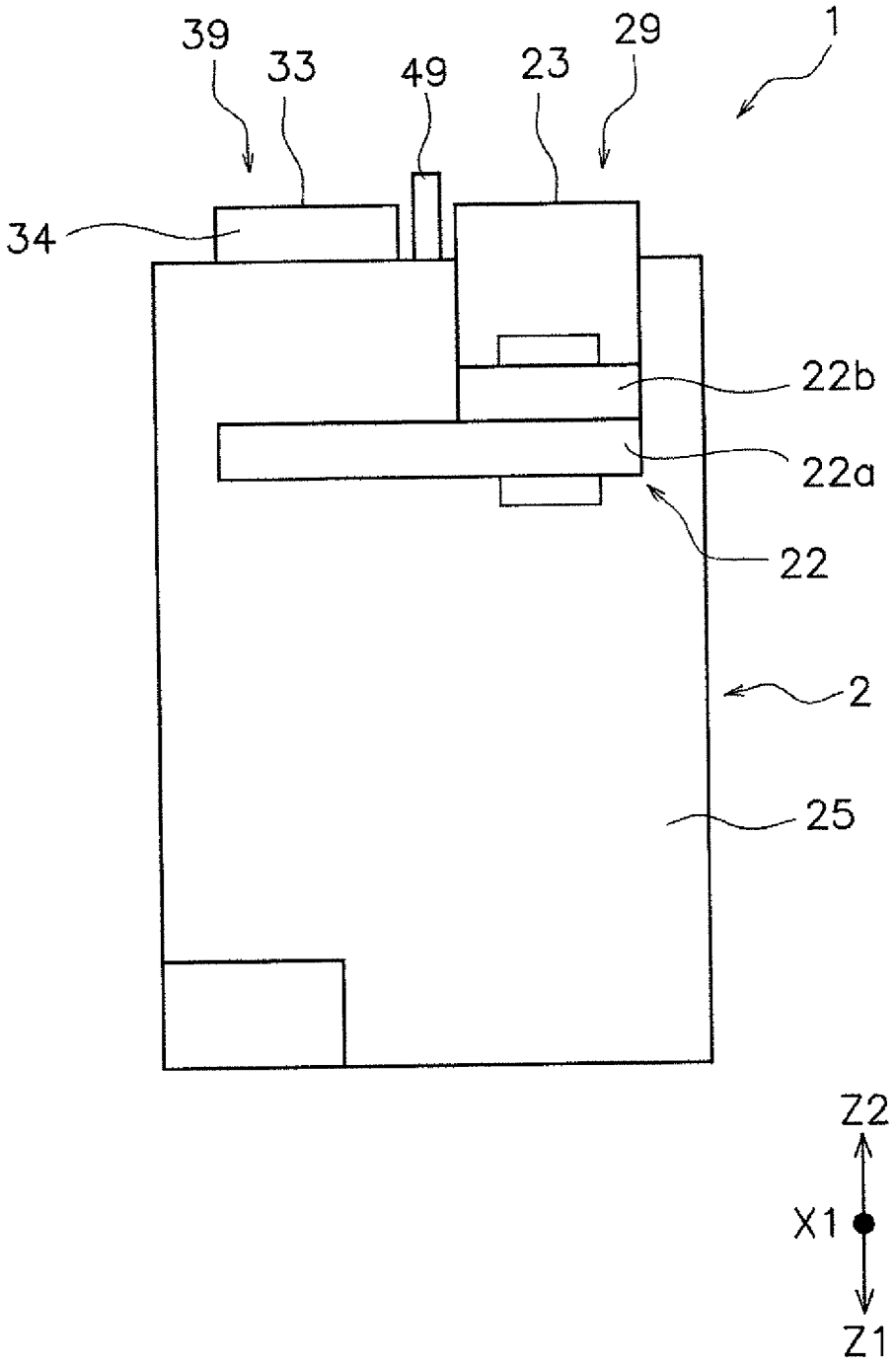
FIG. 11 is a side view of the relay according to the third modified example.

FIG. 10A is a plan view of the relay 1 according to a third modified example. FIG. 10B is a front view of the relay 1 according to the third modified example. FIG. 11 is a side view of the relay 1 according to the third modified example. As illustrated in FIGS. 10A, 10B, and 11, the first extension 23 and the second extension 33 may be disposed outside the case 2 along the outer surface of the case 2.

Further, the case 2 may include the protrusion 49. The protrusion 49 is formed of an insulating material. The protrusion 49 is disposed between the first extension 23 and the second extension 33 and protrudes from the outer surface. The protrusion 49 extends along the first extension 23 and the second extension 33. Even when the first extension 23 and the second extension 33 are disposed close to each other by the protrusion 49, it is possible to improve the insulation between the first extension 23 and the second extension 33 it can.

Figure 12:
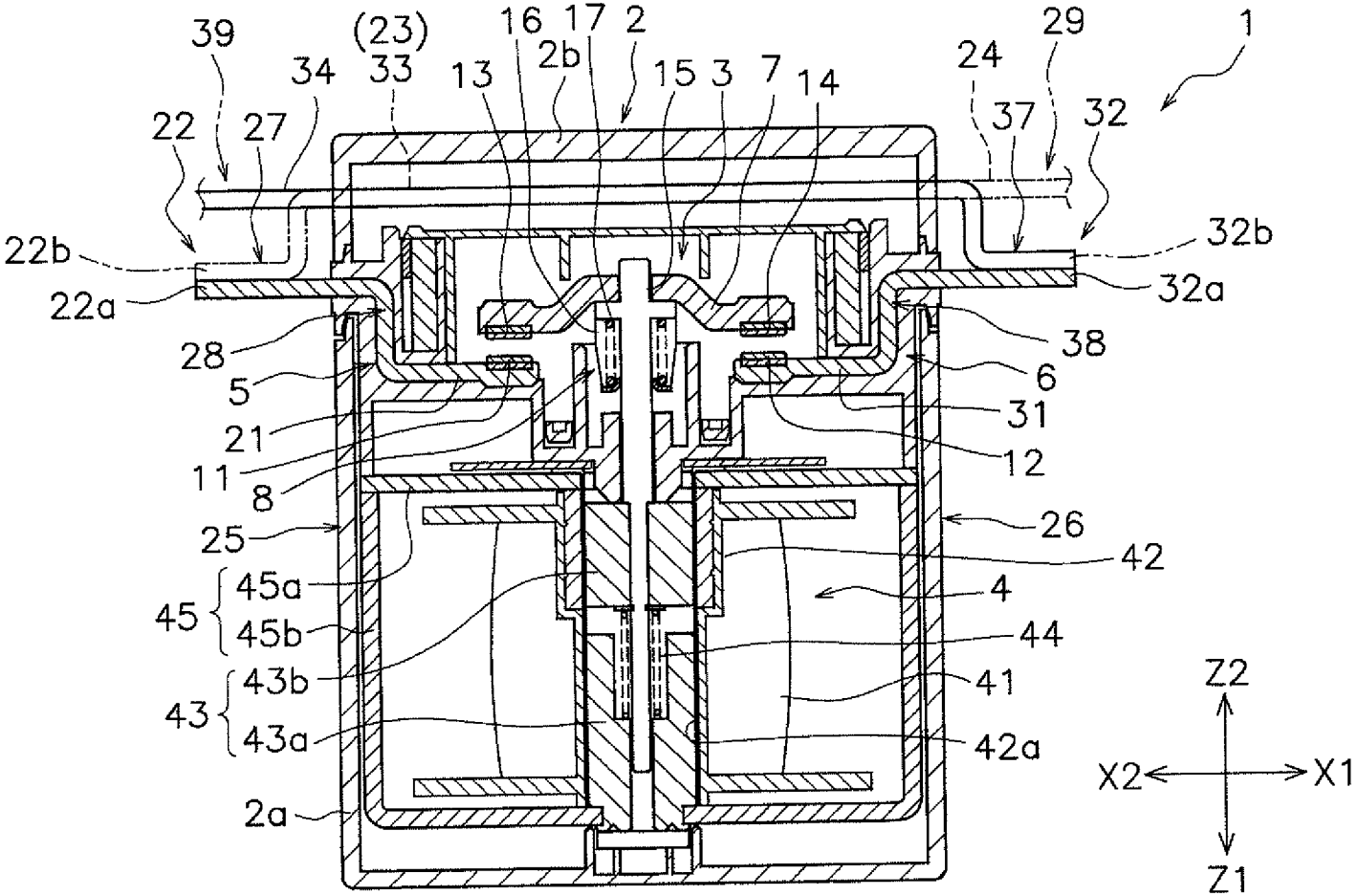
FIG. 12 is a sectional view of a relay according to a fourth modified example.
Figure 13:
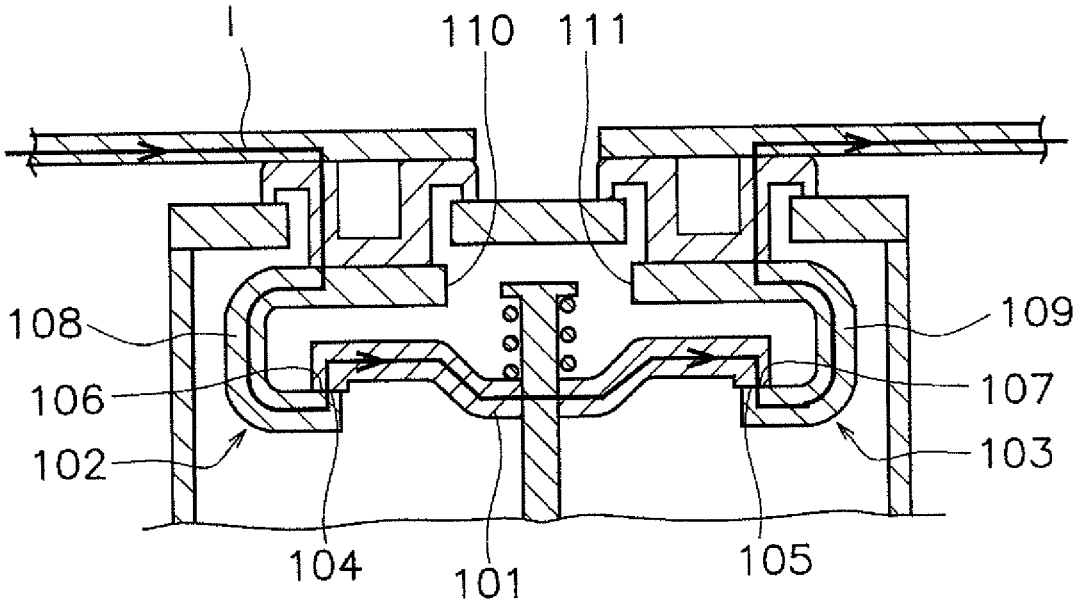
FIG. 13 is a view illustrating a configuration of a relay according to a prior art.

FIG. 12 is a sectional view of the relay 1 according to a fourth modified example. As illustrated in FIG. 12, the first extension 23 and the second extension 33 may be disposed in the accommodation space inside the case 2. A portion of the first fixed terminal 5 other than the first external connection 24 and the first intermediate portion 22 may be disposed in the accommodation space inside the case 2. The first external connection 24 and the first intermediate portion 22 may be disposed outside the case 2. A portion of the second fixed terminal 6 other than the second external connection 34 and the second intermediate portion 32 may be disposed in the accommodation space inside the case 2. The second external connection 34 and the second intermediate portion 32 may be disposed outside the case 2.

Alternatively, only the first external connection 24 of the first fixed terminal 5 may be disposed outside the case 2, and a portion other than the first external connection 24 may be disposed in the accommodation space in the case 2. Only the second external connection 34 of the second fixed terminal 6 may be disposed outside the case 2 and a portion other than the second external connection 34 may be disposed in the accommodation space in the case 2.

According to one or more embodiments of the present invention, by increasing the electromagnetic repulsive force in a direction to press the movable contact against the fixed contact, it is possible to prevent a decrease in contact pressure between the contacts.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A relay comprising:

a case;

a first fixed terminal including a first fixed contact;

a second fixed terminal including a second fixed contact;

a movable touch piece including a first movable contact that is disposed facing the first fixed contact and a second movable contact that is disposed facing the second fixed contact, the movable touch piece being disposed in the case and disposed so as to be movable in a contact direction in which the first movable contact and the second movable contact come into contact with the first fixed contact and the second fixed contact and a separation direction in which the first movable contact and the second movable contact separate from the first fixed contact and the second fixed contact, wherein the first fixed terminal includes:

a first contact support configured to support the first fixed contact, a first extension extending in a first direction from the first movable contact to the second movable contact, and a first external connection connected to the first extension and protruding in the first direction from the case, wherein the second fixed terminal includes a second contact support configured to support the second fixed contact, a second extension extending in a second direction from the second movable contact to the first movable contact, and a second external connection connected to the second extension and protruding in the second direction from the case, and wherein at least a part of the first extension overlaps with the movable touch piece as viewed in a movement direction of the movable touch piece.

2. The relay according to claim 1, wherein at least a part of the second extension overlaps with the movable touch piece as viewed in the movement direction of the movable touch piece.

3. The relay according to claim 1, wherein the first extension and the second extension are arranged symmetrically with respect to a center line of the movable touch piece extending in the movement direction of the movable touch piece.

4. The relay according to claim 1, wherein the first external connection and the second external connection are disposed to be flush with each other.

5. The relay according to claim 1, wherein the first fixed terminal includes an intermediate portion having a shape folded back from the first contact support toward the first extension, wherein the case includes a partition disposed between the intermediate portion and the second external connection, and wherein the partition is formed of an insulating material.

6. The relay according to claim 5, wherein the partition includes a division wall disposed between the intermediate portion and the second external connection, and a support disposed facing the intermediate portion and configured to support the intermediate portion.

7. The relay according claim 1, wherein the first extension and the second extension are disposed outside the case along an outer surface of the case.

8. The relay according to claim 7, wherein the case includes a protrusion disposed between the first extension and the second extension and protruding from the outer surface, and wherein the protrusion is formed of an insulating material.

9. The relay according to claim 1, wherein the first extension and the second extension are embedded in the case.

10. The relay according to claim 1, wherein the first extension and the second extension are disposed in a housing space in the case.

11. The relay according to claim 2, wherein the first extension and the second extension are arranged symmetrically with respect to a center line of the movable touch piece extending in the movement direction of the movable touch piece.

12. The relay according to claim 2, wherein the first external connection and the second external connection are disposed to be flush with each other.

13. The relay according to claim 3, wherein the first external connection and the second external connection are disposed to be flush with each other.

14. The relay according to claim 2, wherein the first fixed terminal includes an intermediate portion having a shape folded back from the first contact support toward the first extension, wherein the case includes a partition disposed between the intermediate portion and the second external connection, and wherein the partition is formed of an insulating material.

15. The relay according to claim 3, wherein the first fixed terminal includes an intermediate portion having a shape folded back from the first contact support toward the first extension, wherein the case includes a partition disposed between the intermediate portion and the second external connection, and wherein the partition is formed of an insulating material.

16. The relay according to claim 4, wherein the first fixed terminal includes an intermediate portion having a shape folded back from the first contact support toward the first extension, wherein the case includes a partition disposed between the intermediate portion and the second external connection, and wherein the partition is formed of an insulating material.

17. The relay according claim 2, wherein the first extension and the second extension are disposed outside the case along an outer surface of the case.

18. The relay according claim 3, wherein the first extension and the second extension are disposed outside the case along an outer surface of the case.

19. The relay according claim 4, wherein the first extension and the second extension are disposed outside the case along an outer surface of the case.

20. The relay according claim 5, wherein the first extension and the second extension are disposed outside the case along an outer surface of the case.

* * * * *